US007428445B2

(12) United States Patent
Lee

(10) Patent No.: US 7,428,445 B2
(45) Date of Patent: Sep. 23, 2008

(54) METHOD FOR CONSTRUCTING MENU IN WASHING MACHINE INTEGRALLY HAVING DRIER

(75) Inventor: Bae Jin Lee, Busan (KR)

(73) Assignee: LG Electronics Inc., Seoul (KR)

( * ) Notice: Subject to any disclaimer, the term of this patent is extended or adjusted under 35 U.S.C. 154(b) by 604 days.

(21) Appl. No.: 11/043,044

(22) Filed: Jan. 27, 2005

(65) Prior Publication Data

US 2006/0021153 A1 Feb. 2, 2006

(30) Foreign Application Priority Data

Jul. 28, 2004 (KR) ..... 10-2004-0059134

(51) Int. Cl.
*G06F 19/00* (2006.01)
*B29C 39/00* (2006.01)

(52) U.S. Cl. ..... 700/180; 8/158; 68/12.01; 68/12.27; 715/736

(58) Field of Classification Search ..... 700/180; 8/158; 68/12.01, 12.27; 715/736
See application file for complete search history.

(56) References Cited

U.S. PATENT DOCUMENTS 5,228,212 A * 7/1993 Turetta et al. ..... 34/493
7,031,260 B1 * 4/2006 Tomita et al. ..... 370/242
7,246,395 B2 * 7/2007 Buckroyd et al. ..... 8/158
2002/0005787 A1 * 1/2002 Gabai et al. ..... 340/825.69
2003/0196460 A1 * 10/2003 Lyu et al. ..... 68/13 R
2004/0019667 A1 * 1/2004 Slemmer et al. ..... 709/223

FOREIGN PATENT DOCUMENTS

DE 19802650 A1 * 7/1999

* cited by examiner

*Primary Examiner*—Michael D Masinick
(74) *Attorney, Agent, or Firm*—Birch, Stewart, Kolasch & Birch, LLP

(57) ABSTRACT

There is provided a method for constructing a menu in a washing machine integrally having a drier where communication is possible. The method includes the steps of: transmitting sent data if a power is applied; reading received data that depends on transmission of the sent data; judging a connection state of the drier and the washing machine using the read and received data and displaying differently contents of a menu screen displayed on the display unit according to the judgment results. Therefore, a menu construction is changed depending on a communication state of the drier and the washing machine, so that whether one machine is independently used or works in cooperation with the other machine can be more easily recognized and a menu selection and checking are easy, thus user convenience can be improved.

18 Claims, 3 Drawing Sheets

METHOD FOR CONSTRUCTING MENU IN WASHING MACHINE INTEGRALLY HAVING DRIER

This application claims the benefit of the Korean Application No. P2004-59134 filed on Jul. 28, 2004 which is hereby incorporated by reference.

BACKGROUND OF THE INVENTION

1. Field of the Invention

The present invention relates to a drier and a washing machine, and more particularly, to a method for constructing a menu in a washing machine integrally having a drier.

2. Discussion of the Related Art

Generally, a washing machine is an apparatus for washing the laundry by performing a washing, a rinsing, and a dewatering cycles according to a predetermined algorithm. A washing machine is divided into a pulsator type, an agitator type, and a drum type depending on a washing type.

A clothing drier is an apparatus for automatically drying clothing in its wet state that has passed through a washing cycle. The clothing drier is divided into a dehumidifying type and a discharging type depending on a drying type and recently a demand thereof is increasing.

In Korea, a drier and a washing machine are not separately used but a washing machine having a drying function is preferred.

In the meantime, in lots of countries including the Europe, the United States, and Canada, a user prefers to use a washing machine and a drier separately, so that the drier and the washing machine are installed and used adjacently each other.

In view of such trends, a washing machine integrally having a drier such that a drier and a washing machine are connected by a communication cable so that data may be shared by both the washing machine and the drier, has been developed and brought out to the market.

That is, washing and dry-related information are shared by connecting the drier with the washing machine that are adjacently installed each other so that communication between them may be possible.

As illustrated in FIG. 1, a general washing machine integrally having a drier has a washing machine 200 and a drier 300 adjacently installed and the washing machine 200 is connected with the drier 300 by a communication cable (not shown) for communication between them.

The washing machine 200 and the drier 300 have control panels 400 and 500 on their upper side, respectively. The control panel 400 of the washing machine 200 includes: a key manipulation unit 410 for inputting user instructions so as to control an operation of the washing machine 200; and a display unit 420 for displaying the instructions inputted from the key manipulation unit 410, various menu, and a washing performance state.

The control panel 500 of the drier 300 includes: a key manipulation unit 510 for inputting user instructions so as to control an operation of the drier 300; and a display unit 520 for displaying the instructions inputted from the key manipulation unit 510, various menu, and a drying performance state.

Here, if a power is applied to the washing machine 200 and the drier 300, various menu screens are displayed through the display units 420 and 520. A washing machine-related menu and a drier-related menu are displayed on the relevant display units 420 and 520, respectively and a communication-related menu displayed through communication between the washing machine 200 and the drier 300 is displayed on both the display unit 420 of the washing machine 200 and the display unit 520 of the drier 300.

In the above-described washing machine integrally having the drier, if a user intends to perform washing using the washing machine 200, a user inputs washing cycle conditions desired by a user using the key manipulation unit 410, then the washing cycle is performed according to the washing cycle conditions inputted by a user.

In addition, if a user intends to dry wet clothing that has passed through the washing cycle using the drier 300, the clothing is moved from the washing machine 200 to the drier 300. After that, a user inputs drying cycle conditions desired by a user using the key manipulation unit 510 of the control panel 500, then the drying cycle is performed according to the drying cycle conditions inputted by a user.

In the meantime, if a user intends to perform a drying cycle in the drier considering washing information inputted from the washing machine 200 (washer recommended cycle), the drier can receive the washing information inputted to the washing machine 200 through communication with the washing machine 200 and perform an optimum drying cycle considering the received washing information.

The above-described related art washing machine integrally having the drier can provide more convenient and effective washing and drying functions to a user through communication between the washing machine 200 and the drier 300.

In the related art washing machine integrally having the drier, if a system power is applied, a washing-related menu and a communication-related menu are displayed on the display unit on a washing machine side and a drying-related menu and a communication-related menu are displayed on the display unit on a drying machine side.

However, in the related art, the communication-related menus are displayed on both the washing machine and the drier regardless of whether the washing machine is connected with the drier or not.

That is, even in case the washing machine is not connected with the drier, the communication-related menus are displayed, and the unnecessary menus that are not executed are displayed, causing confusion to a user.

SUMMARY OF THE INVENTION

Accordingly, the present invention is directed to a method for constructing a menu in a washing machine integrally having a drier that substantially obviates one or more problems due to limitations and disadvantages of the related art.

An object of the present invention is to provide a method for constructing a menu in a washing machine integrally having a drier capable of improving user convenience by reconstructing a menu depending on a connection state of the washing machine and the drier.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for constructing a menu in a washing machine integrally having a drier in a washing machine and a drier that have display units, respectively, and sharing information for washing and drying, the method including the steps of: transmitting sent data if a power is applied; reading received data that corresponds to the transmitted sent data; and judging a connection state of the washing machine and the drier using the read received data and displaying a menu by changing information of a menu screen displayed on the display unit depending on results of the judgment.

Here, the received data that corresponds to the transmitted sent data is compared with the sent data. If the received data is identical with the sent data as a result of the comparison, it is judged that the washing machine is not connected with the drier by the communication cable, and the communication-related menu screen is not displayed on the display unit.

On the contrary, if the received data is not identical with the sent data as a result of the comparison, it is judged that the washing machine is connected with the drier by the communication cable, and the communication-related menu screen is displayed on the display unit.

Here, the communication-related menu displayed on the display unit may include information regarding drying cycle conditions optimized on the basis of conditions inputted by a user when a washing cycle is performed and information extracted during the washing cycle at the washing machine.

Further, the steps of transmitting the sent data and reading the received data that corresponds to the sent data may be repeated periodically.

After the steps of transmitting the sent data and reading the received data are repeated as much as the predetermined number of times, the step of judging the connection state of the washing machine and the drier may be performed.

Other purposes, characteristics, and advantages of the present invention will be apparent upon examination of the following detailed description of preferred embodiments with reference to the accompanying drawings.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Like the related art, a washing machine integrally having a drier of the present invention has a washing machine 200 and a drier 300 adjacently installed each other and connected through a serial communication cable so that communication may be possible between the washing machine 200 and the drier 300.

For example, the drier 300 can calculate an optimum drying cycle time considering user's washing conditions inputted to the washing machine 200 through communication between the washing machine 200 and the drier 300.

The present invention reconstructs and provides a menu screen for selecting cycle conditions of the washing machine 200 and the drier 300 depending on a connection state of the washing machine 200 and the drier 300.

A method for constructing a menu in the washing machine integrally having the drier according to the present invention will be described in detail in the following.

Though a menu construction algorithm of the present invention is applied to both the washing machine 200 and the drier 300, description will be made mainly for the drier 300.

Figure 1:
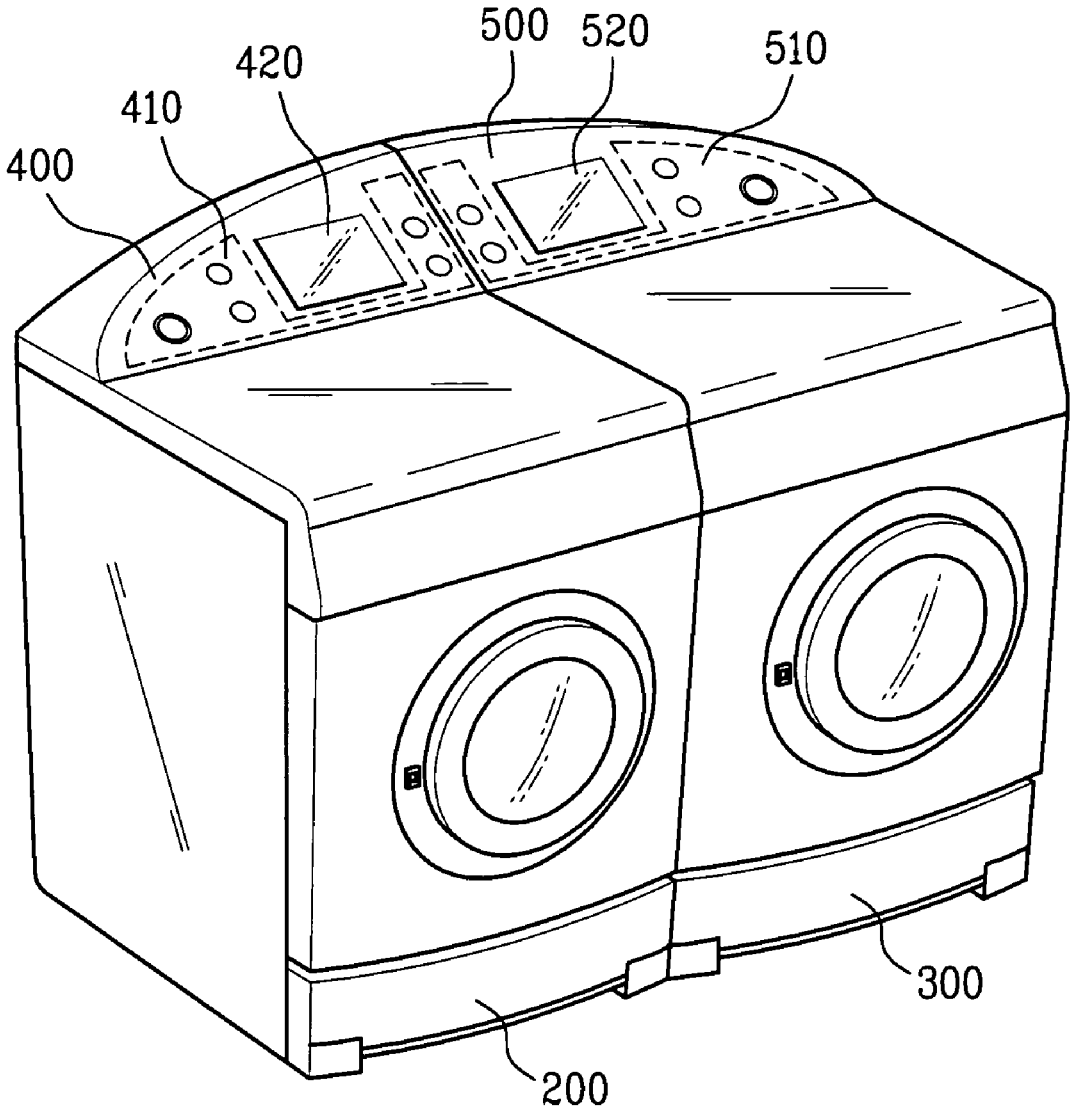
FIG. 1 is a view illustrating a general washing machine integrally having a drier.
Figure 2:
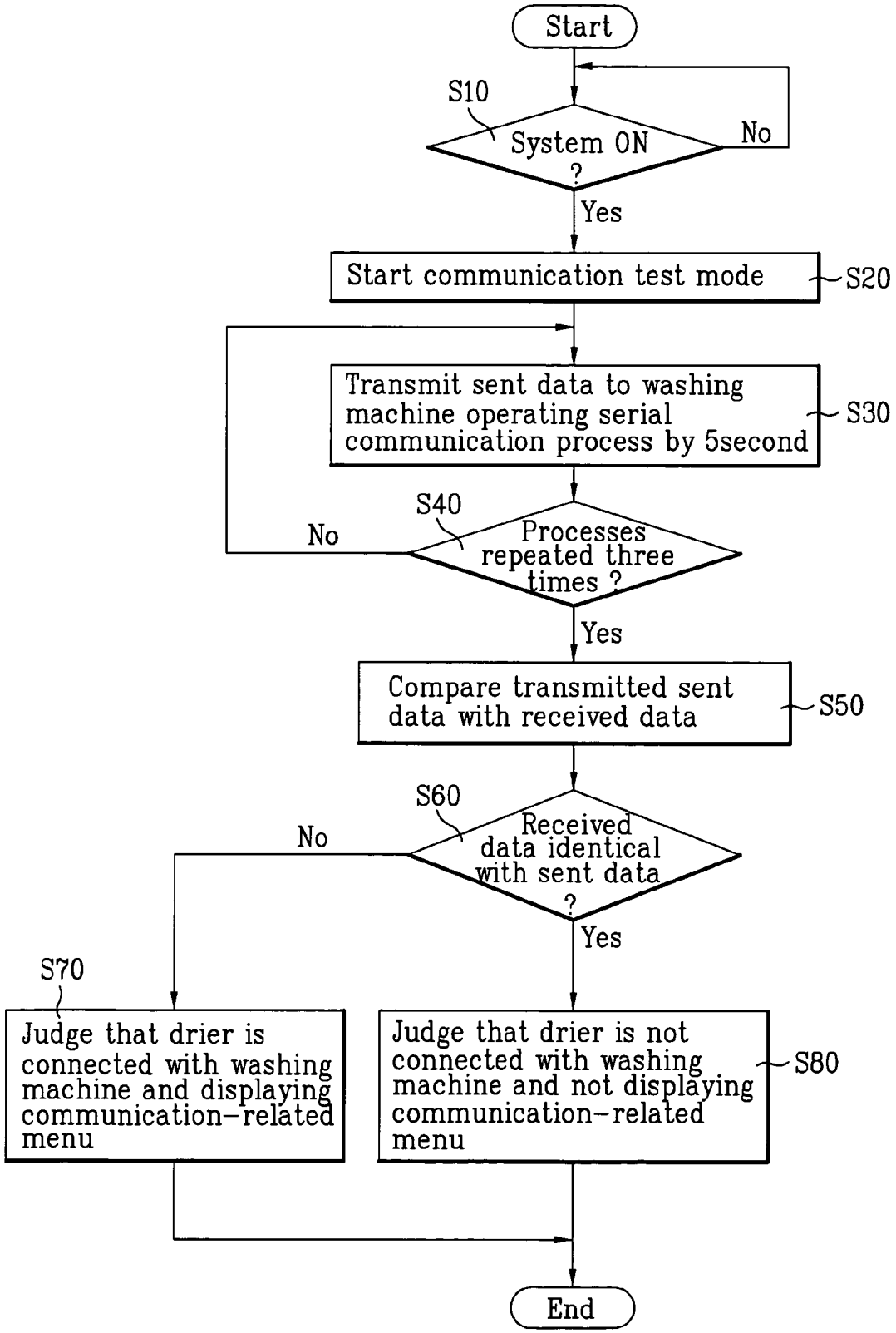
FIG. 2 is a flowchart illustrating a method for constructing a menu of a washing machine integrally having a drier according to the present invention.

Referring to FIG. 2, if a system power is turned-on first (S10), a communication test mode is performed to operate a serial communication process by a predetermined period (five second). At this point, the drier 300 transmits sent data for testing a communication state of the washing machine 200 (referred to as 'test data' hereinafter) to the washing machine 200 (S20 and S30).

Such communication processes S20 and S30 may be repeatedly performed more than three times to minimize a data error.

If the communication processes S20 and S30 are performed three times (S40), the received data provided as a feedback for the test data transmitted from the drier 300 is read. After that, the received data is compared with the test data and whether the received data is identical with the test data is judged (S50 and S60).

Here, if the washing machine 200 is not connected with the drier 300 by the communication cable, the sent data is read as it is, thus the two data are the same upon comparison of the received data with the test data.

If the washing machine 200 is connected with the drier 300 by the communication cable, a reception side that has received the test data sends data that corresponds thereto, thus the two data are not the same upon comparison of the received data with the test data. Such compassion results are used for the above judgment.

If the received data is not the same as the test data as a result of the judgment (S50), it is judged that the washing machine 200 is connected with the drier 300 by the communication cable and it is recognized that the drier 300 is in a state of being able to communicate with the washing machine 200 and simultaneously a menu screen that includes a communication-related menu which requires communication with the washing machine 200 is displayed (S70).

Here, contents displayed on the menu screen include information regarding drying cycle conditions optimized on the basis of conditions inputted by a user upon performance of the washing cycle and information extracted during the washing cycle at the washing machine.

Figure 3A:
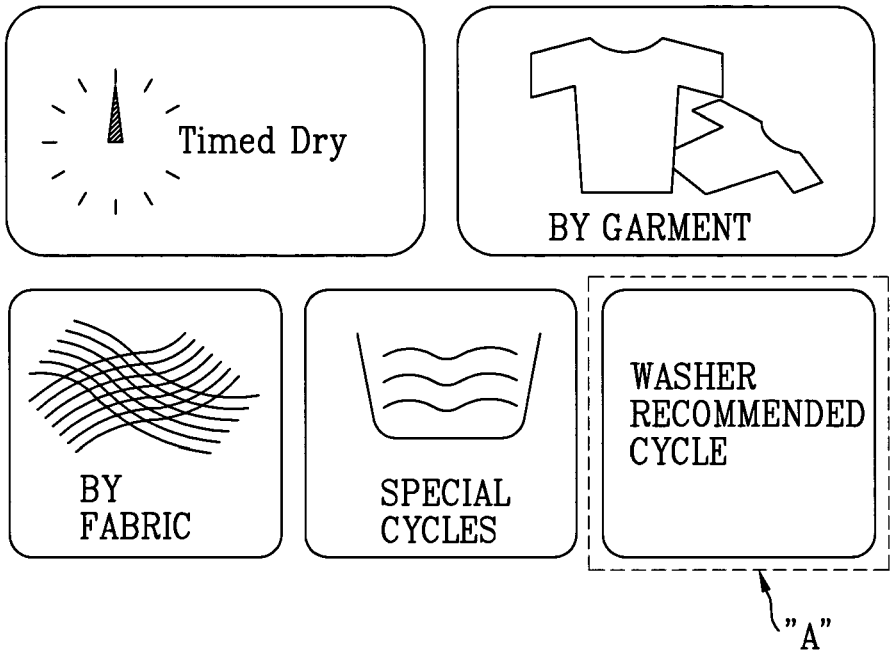
FIG. 3A is a view illustrating a menu screen that includes a communication-related menu.

For example, as illustrated in FIG. 3A, since a washer recommended cycle "A" that performs the drying cycle considering the washing cycle conditions of the washing machine 200 is a menu that requires communication with the washing machine 200, the menu screen that includes the washer recommended cycle is displayed on the drier 300.

In the meantime, if the received data is identical with the test data as a result of the judgment (S50), it is judged that the washing machine 200 is not connected with the drier 300 and it is recognized that the drier 300 is in a state of not being able to communicate with the washing machine 200 and simultaneously a menu screen that excludes a communication-related menu which requires communication with the washing machine 200 is displayed (S80).

Figure 3B:
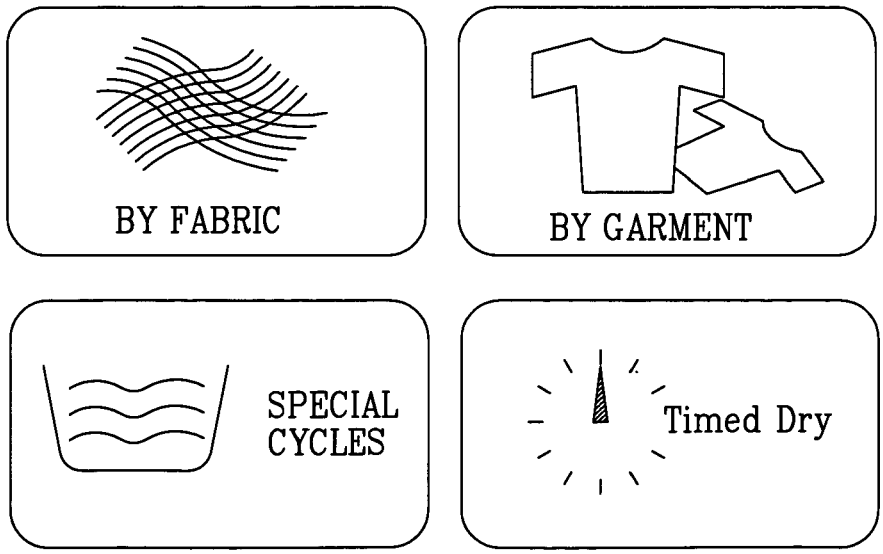
FIG. 3B is a view illustrating a menu screen that excludes a communication-related menu.

That is, as illustrated in FIG. 3B, only menus that can be operated by an independent drier alone is displayed with the menu such as the "washer recommended cycle" that requires communication with the washing machine 200 excluded.

Similarly, also in case of the washing machine 200, a connection state with the drier 300 is checked first. If the washing machine 200 is in a state of being able to communicate with the drier 300, a menu that includes a communication-related menu requiring communication with the drier 300 is displayed. If the washing machine 200 is in a state of not being able to communicate with the drier 300, only menu that can be operated independently by the washing machine alone is displayed.

With the screen that includes the menu such as the washer recommended cycle "A" which performs the drying cycle displayed on the drier 300, the drying cycle starts. It is obvious that if a user does not input separate conditions upon performance of the drying cycle, a control can be made so that the drying cycle may be performed on the basis of optimized information regarding the drying cycle conditions.

The method for constructing the menu in the washing machine integrally having the drier has the following effects.

First, the menu construction is changed depending on a communication state between the drier and the washing machine, so that whether each machine is used independently or two machines cooperate through communication can be recognized.

Second, only the menu that can be independently operated is displayed, or the menu that includes the communication-related menu requiring communication is displayed depending on a connection state of the drier and the washing machine, whereby user convenience can be improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for constructing a menu in a washing machine integrally having a dryer, the washing machine and the dryer each having a display unit, and sharing information for washing and drying, the method comprising:

transmitting test data if power is applied to the washer and the dryer;

reading received data that corresponds to the transmitted test data; and judging a connection state of the washing machine and the dryer using the read received data and displaying a menu by changing information of a menu screen displayed on at least one display unit depending on results of the judgment.

2. The method of claim 1, further comprising:

comparing the test data with the received data that corresponds to the transmitted test data; and if the received data is identical with the test data, judging that the washing machine is not connected with the dryer by a communication cable.

3. The method of claim 2, further comprising:

if it is judged that the washing machine is not connected with the dryer by the communication cable, not displaying a communication-related menu screen on at least one display unit.

4. The method of claim 1, further comprising:

comparing the test data with the received data that corresponds to the transmitted test data; and if the received data is not identical with the test data, judging that the washing machine is connected with the dryer by a communication cable.

5. The method of claim 4, further comprising:

if it is judged that the washing machine is connected with the dryer by the communication cable, displaying a communication-related menu screen on at least one display unit.

6. The method of claim 5, wherein the communication-related menu includes information regarding drying cycle conditions optimized on the basis of conditions inputted by a user upon performance of the washing cycle and information extracted during the washing cycle at the washing machine.

7. The method of claim 6, wherein the optimized information regarding the drying cycle conditions is displayed on the display unit of the dryer.

8. The method of claim 7, wherein if a user does not input separate conditions upon performance of the drying cycle, the drying cycle is performed on the basis of the optimized information regarding the drying cycle conditions.

9. The method of claim 1, wherein transmitting the test data and reading the received data are repeated periodically.

10. The method of claim 1, wherein transmitting the test data and reading the received data are repeated a predetermined number of times, and, thereafter, judging the connection state of the washing machine and the dryer is performed.

11. A method for constructing a menu in a washing machine integrally having a dryer, the washing machine and the dryer each having a display unit, and sharing information for washing and drying, the method comprising:

transmitting test data if a power is applied;

reading received data that corresponds to the transmitted test data;

judging a connection state of the washing machine and the dryer depending on the read received data;

if the dryer is connected with the washing machine, displaying a communication-related menu screen that requires communication between the dryer and the washing machine; and if the dryer is not connected with the washing machine, not displaying the communication-related menu screen.

12. The method of claim 11, further comprising:

comparing the test data with the received data that corresponds to the transmitted test data; and if the received data are identical with the test data, judging that the washing machine is not connected with the dryer by a communication cable.

13. The method of claim 11, further comprising:

comparing the test data with the received data that corresponds to the transmitted sent data; and if the received data is not identical with the test data, judging that the washing machine is connected with the dryer by a communication cable.

14. The method of claim 11, wherein the communication-related menu includes information regarding drying cycle conditions optimized on the basis of conditions inputted by a user upon performance of the washing cycle and information extracted during the washing cycle at the washing machine.

15. The method of claim 14, wherein the optimized information regarding the drying cycle conditions is displayed on the display unit of the dryer.

16. The method of claim 15, wherein if a user does not input separate conditions upon performance of the drying cycle, the drying cycle is performed on the basis of the optimized information regarding the drying cycle conditions.

17. The method of claim 11, wherein transmitting the test data and reading the received data are repeated periodically.

18. The method of claim 11, wherein transmitting the sent data and reading the received data are repeated a predetermined number of times, and thereafter, judging the connection state of the washing machine and the dryer is performed.

* * * * *